United States Patent [19]

Milberger et al.

[11] Patent Number: 5,029,647

[45] Date of Patent: Jul. 9, 1991

[54] SUBSEA WELLHEAD STABILIZATION

[75] Inventors: Lionel J. Milberger; Herman O. Henderson, Jr.; Stanley Hosie, all of Houston, Tex.

[73] Assignee: Vetco Gray Inc., Houston, Tex.

[21] Appl. No.: 515,858

[22] Filed: Apr. 27, 1990

[51] Int. Cl.[5] ..... E21B 33/035

[52] U.S. Cl. ..... 166/367; 166/368; 285/142

[58] Field of Search ..... 166/335, 350, 351, 352, 166/355, 356, 344, 367, 368, 348, 349; 175/7; 285/140, 142, 143, 225, 226, 231

[56] References Cited

U.S. PATENT DOCUMENTS

| | | | |
|---|---|---|---|
| 3,211,223 | 10/1965 | Hoch . | |
| 3,600,770 | 8/1971 | Halling | 285/411 |
| 3,602,303 | 8/1971 | Blenkarn . | |
| 3,952,526 | 4/1976 | Watkins et al. | 285/231 |
| 3,952,799 | 4/1976 | Simpson | 166/187 |
| 4,086,971 | 5/1978 | Hall et al. | 175/7 |
| 4,231,436 | 11/1980 | Waller | 175/7 |
| 4,415,186 | 11/1983 | Maestrami . | |
| 4,499,950 | 2/1985 | Watkins . | |
| 4,580,788 | 4/1986 | Rabe et al. | 285/343 |
| 4,728,224 | 3/1988 | Salama et al. | 166/367 |
| 4,751,968 | 6/1988 | Ames et al. . | |
| 4,854,781 | 8/1989 | Sparks et al. | 166/367 |

FOREIGN PATENT DOCUMENTS

| | | | |
|---|---|---|---|
| 711560 | 6/1965 | Canada | 285/142 |
| 1388543 | 4/1988 | U.S.S.R. | 166/368 |

*Primary Examiner*—Ramon S. Britts
*Assistant Examiner*—Roger Schoeppel
*Attorney, Agent, or Firm*—James E. Bradley

[57] ABSTRACT

A subsea well having inner and outer tubular housings has features to reduce bending movement of the inner housing within the outer housing. The inner and outer housings have mating wedging surface axially spaced apart from each other. These tapered surfaces are spaced so as to cause the inner housing to wedge within the outer housing as it is lowered into place. A latch latches the inner housing to the outer housing once lowered into place. A sleeve of elastomeric material locates on the exterior of the lower extension of the inner housing. This sleeve extends downward a selected distance to prevent bonding of cement to the inner housing in this area. Part of the latch is mounted to a ring clamp that releasably mounts to the outer housing.

9 Claims, 5 Drawing Sheets

SUBSEA WELLHEAD STABILIZATION

BACKGROUND OF THE INVENTION

1. Field of the Invention:

This invention relates in general to subsea wells, and in particular to a means for stabilizing within an outer housing an inner housing that secures to a riser leading to the surface.

2. Description of the Prior Art:

In a subsea well of the type concerned herein, a guide base will be placed on the sea floor. An outer housing will be inserted into the guide base. The outer housing has large diameter conduit, typically 30 inch, that extends into the earth a selected distance. The 30 inch conduit will be cemented in place.

Then, an inner housing will be lowered into the outer housing. The inner housing will be secured to lesser diameter casing, normally about 20 inch. The 20 inch casing will be cemented in place. Typically, there will be a clearance between the outer housing interior and the inner housing exterior. A riser will extend from the inner housing to the drilling vessel.

The drilling vessel will be floating, and thus is subject to wave and wind action. The riser will bend as the drilling vessel moves relative to the subsea well. This causes a bending action on the inner housing. There is a possibility that the repetitive movement could cause fatigue of the inner housing. This could cause the inner housing to part.

Cement located between the inner and outer housing helps to prevent relative movement. Also, long tapered sections extend downward from the inner housing to the casing to reduce the bending stress. While this is successful, these long tapered sections are expensive to manufacture. Also, if the cement does not extend high enough in the clearance between the inner and outer housings, support for bending movement would be lacking.

There have been proposals in the past to stabilize the inner housing within the outer housing by means of slips and slip rings, such as shown in U. S. Pat. No. 4,499,950, Bruce J. Watkins, issued Feb. 19, 1985, and U.S. Pat. No. 4,751,968, Thomas J. Ames, et al, issued June 21, 1988. Improvements are desirable.

Also, if the well is to be abandoned subsequently it is desirable to remove and retrieve the inner housing. The operator can cut the casing below the inner housing. However, pulling the inner housing from the outer housing can be difficult.

SUMMARY OF THE INVENTION

In this invention, the inner housing and the outer housing wedge within one another to stabilize movement of the inner housing. This is handled by upper and lower tapered sections formed in the outer housing bore and on the inner housing exterior. These tapered sections taper at a slight angle relative to vertical. The sections are dimensioned so that the inner housing will wedge within the outer housing as it is lowered in place.

A latch subsequently latches the inner housing to the outer housing. Part of the latch is located on a clamp ring which clamps to the upper end of the housing. The clamp ring bolts together. Removing the clamp ring allows the latch to be disengaged. This allows the inner housing to be retrieved from the outer housing.

In addition, preferably a sleeve means is employed to prevent cement from contacting the inner housing for a certain distance below the outer housing. This preferably comprises a sleeve which prevents the cement from bonding to the exterior of the inner housing. This sleeve means allows the inner housing to flex a slight amount relative to the cement due to bending loads.

DETAILED DESCRIPTION OF THE INVENTION

Figure 1:
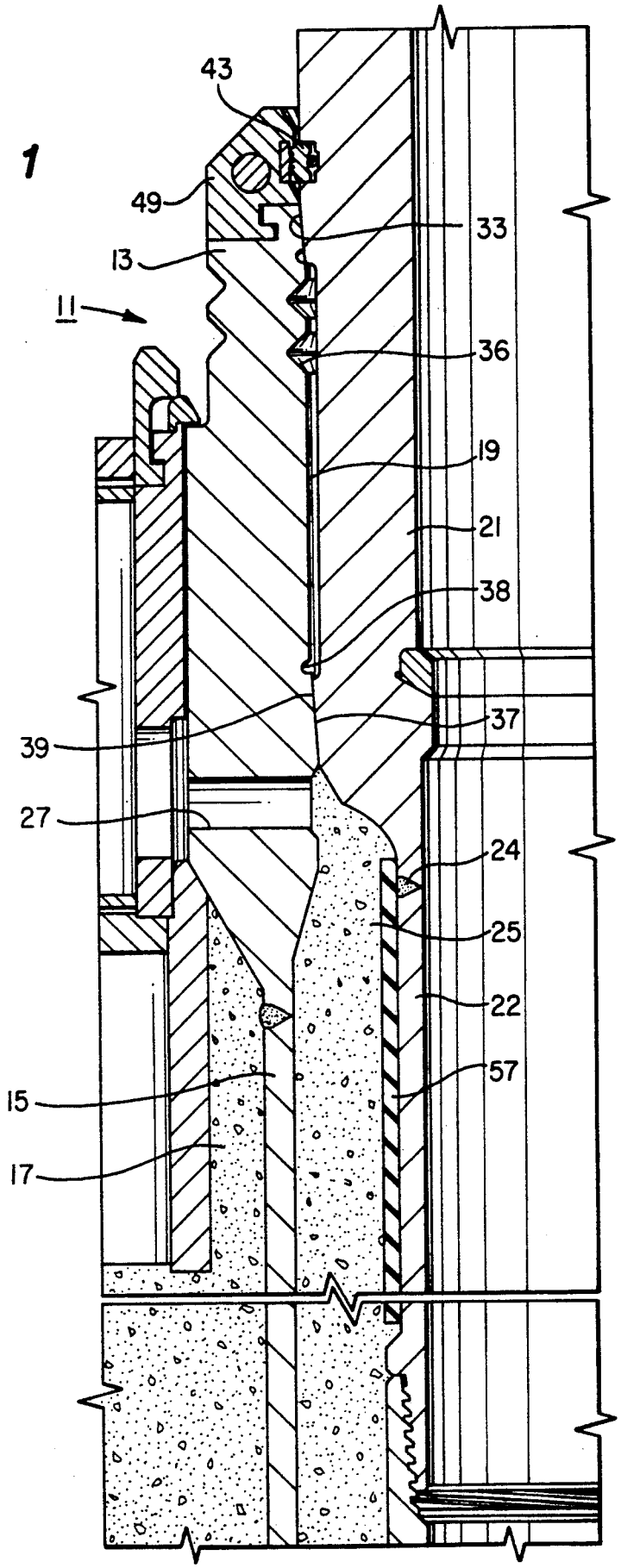
FIG. 1 is a quarter vertical sectional view of a subsea well constructed in accordance with this invention.

Referring to FIG. 1, a guide base 11 will be located on the sea floor. An outer housing 13 will insert into a receptacle within the guide base 11 in a conventional manner. The outer housing 13 is a large tubular member secured on its lower end to a string of conductor 15. The conductor 15 is preferably 30 inch diameter pipe. The conductor 15 will be cemented in place by cement 17. The conductor 15 has a bore 19 extending longitudinally through it.

An inner housing 21 will then be lowered into and landed in the bore 19. The inner housing 21 has a lower portion or extension member 22 which is spaced from the outer housing 13 and considered herein as a lower part of the inner housing 21. Extension member 22 secures by a weld 24 to inner housing 21 and is much thinner in wall section than the thickness of the upper portion of the inner housing 21. Extension member 22 secures on its lower end to a string of casing 23 of lesser than casing 15, preferably 20 inch. Casing 23 extends to a selected depth in the well and is cemented in place by cement 25. Ports 27 in the outer housing 13 allow the flow of cement to return.

Figure 2:
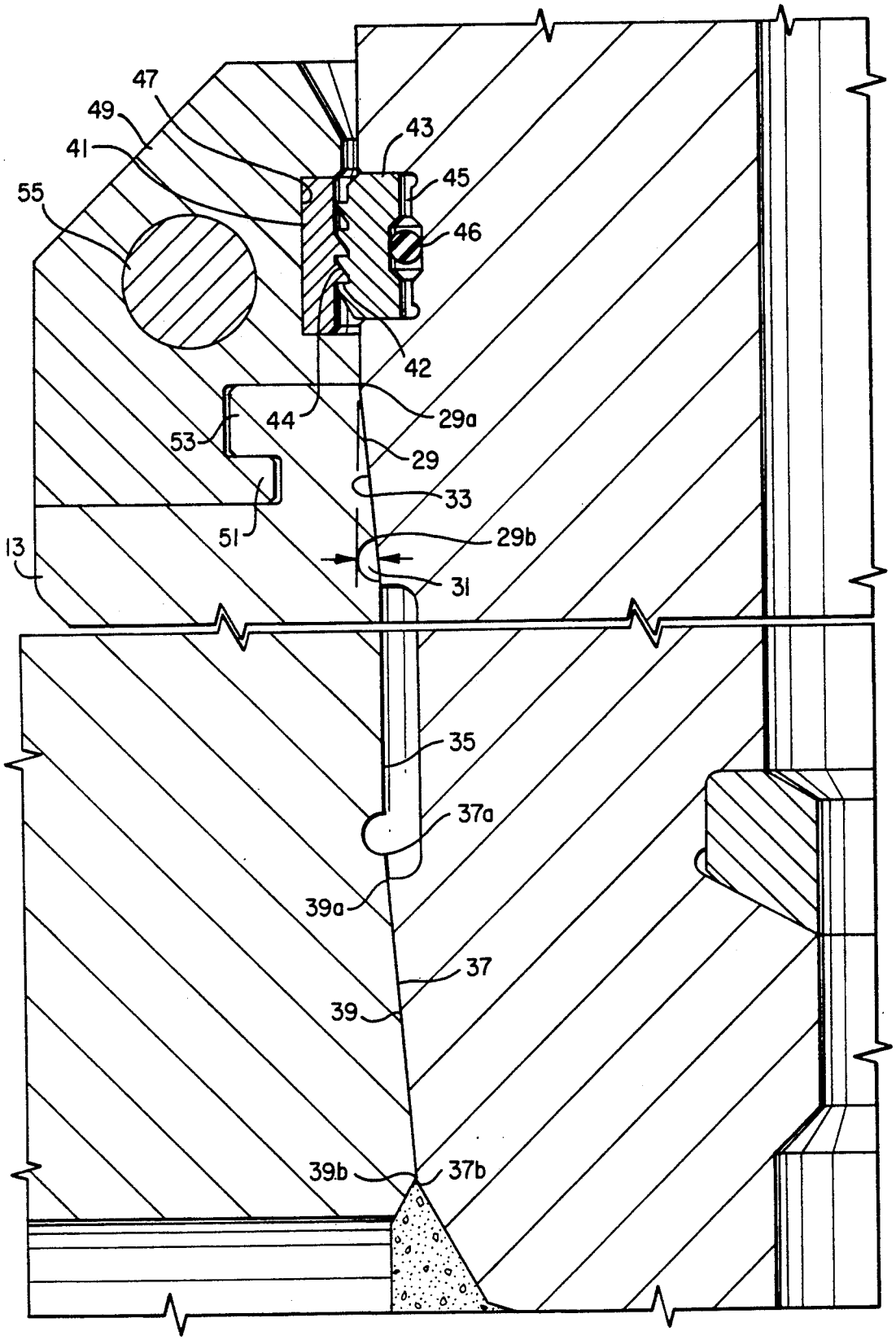
FIG. 2 is an enlarged view of a portion of the inner and outer housings of the subsea well of FIG. 1.

Referring also to FIG. 2, outer housing 13 has an upper tapered section 29. This tapered section 29 is an integrally formed frusto-conical band extending circumferentially around the bore 19. It has an upper edge **29*a* and a lower edge 29*b*. It tapers from a larger diameter at the upper edge 29*a* to a smaller diameter at the lower edge 29*b*. The taper is preferably at an angle 31 in the range from 2 to 8 degrees relative to the longitudinal axis of the outer housing 13**, and in the preferred embodiment is 5 degrees.

Similarly, inner housing 21 has an upper tapered section 33. The upper tapered section 33 has the same taper as angle 31, and also the same axial extent for mating with the tapered section 29. Tapered section 33 is an integrally formed band extending around the exterior of inner housing 21.

A cylindrical section 35 extends downward from the lower edge **29*b* of the upper tapered section 29. A pair of internal grooves 36 are formed in the cylindrical section 35 and used for purposes other than this invention. The diameter of cylindrical section 35 is the same as the diameter of the tapered section 29** measured at the lower edge 29*b*. Similarly, there is a cylindrical section on the exterior of the inner housing 21. There is a difference in diameters between the cylindrical section 35 and the cylindrical section on the exterior of inner housing 21, resulting in a clearance adjacent the cylindrical section 35.

A lower tapered section 37 is formed at the lower end of the cylindrical section 35. There is a considerable axial distance from the upper tapered section 29 to the lower tapered section 37. The axial length of the cylindrical section 35 is approximately five times the axial extent of each tapered section 29 and 37 in the preferred embodiment. The lower tapered section 37 tapers at the same angle as angle 31. It also has the same axial extent as the upper tapered section 29.

The lower tapered section 37 has an upper edge 37*a* and a lower edge 37*b*. The diameter at the upper edge 37*a* is the same as the diameter of the lower edge 29*b* of the upper tapered section 29. The diameter at the lower edge 37*b* is less than the diameter of the upper edge 37*a*. A small radius 38 locates the lower edge 29*b* and the upper edge 37*a*.

The inner housing 21 has a lower tapered section 39 positioned for mating with the tapered section 37. The lower tapered section 39 has an upper edge 39*a* and a lower edge 39*b*. The diameter of the upper edge 39*a* is less than the diameter of the lower edge 29*b* of the upper tapered section 29. This is necessary to allow the inner housing 21 to clear the upper tapered section 29 as the lower tapered section 39 moves past during installation.

Latch means exists for latching the inner housing 21 within the outer housing 13 after the tapered surfaces 29, 33, 37 and 39 have fully engaged each other. The latch means preferably includes a latch ring 41 having circumferential grooves 42 on its exterior. A split latch ring 43 locates within a recess 45 on the exterior of the inner housing 21. The split latch ring 43 has mating teeth or grooves 44 and will ratchet into and latch into the latch ring 41. The split in the latch ring 43 and the depth of the recess 45 allow the latch ring 43 to deflect radially or contract within the recess 45. An elastomeric O-ring 46 locates in the recess 45 behind the latch ring 43. O-ring 46 acts as a spring to urge the latch ring 43 radially outward to an expanded position.

The latch ring 41 is stationarily carried in a recess 47 within a clamp ring 49. Clamp ring 49 mounts releasably to the outer housing 13 and forms the upper end of outer housing 13. Clamp ring 49 is an inflexible ring made up of two halves. Clamp ring 49 has a flange 51 on its lower end that protrudes radially inward for engaging a mating recess in the outer housing 13. The outer housing 13 has a flange 53 that protrudes radially outward and locates on top of the flange 51. A horizontally extending bolt 55 will lock the two halves together.

Referring again to FIG. 1, means exist for isolating the exterior of the extension member 22 of inner housing 21 from cement. The portion that must be isolated starts just above the weld 24 and extends downward from two to ten feet. The means in the preferred embodiment is an elastomeric sleeve 57. Sleeve 57 is about $\frac{1}{8}$ to $\frac{1}{4}$ inch in thickness. Sleeve 57 breaks any shear bond with cement 25 to allow the lower portion of the inner housing 21 to flex. The cement 25 will be in contact with the sleeve 57. Sleeve 57 could also be a heat shrink thermoplastic material, a coating, or a metal tube spaced from the extension member 22 by standoffs.

In operation, when the inner housing 21 is lowered into the outer housing 13, the lower tapered section 39 will move past the upper tapered section 29 and engage the lower tapered section 37. At the same time, the upper tapered section 33 will engage the upper tapered section 29. Because of tolerances, initially one of the tapered sections 33 or 39 will not tightly engage its respective tapered section 29 and 37. A slight radial gap will exist.

The weight of the string above the inner housing 21 will be placed on the inner housing 21. This weight and the mating upper and lower tapered sections 29,33 and 37,39 will cause the inner housing 21 to move farther downward and wedge tightly within the outer housing 13. The tapered sections 29, 37 will slidingly and frictionally engage each other in metal-to-metal contact. The angle 31 results in a locking taper fit. During this movement, the latch ring 43 will ratchet into and engage the latch ring 41, preventing any upward movement of the inner housing 21. The wedging action causes a radial preload force on the inner housing 21.

Cement will be pumped down the riser string and up the annular space surrounding the casing 23. This cement, indicated by the numeral 25, will likely flow up and out the port 27. The cement will not bond to an upper portion of the extension member 22 of the inner housing 21. The cement will flow around and contact sleeve 57.

Subsequently, if the riser begins to bend, a bending force will be placed on the inner housing 21. The wedging tapered surfaces 29, 33, 37 and 39 prevent substantially all movement of the inner housing 21 relative to the outer housing 13. Any slight movement that may still occur will tend to cause the inner housing 21 to flex at a point below the lower tapered section 39. This flexing is allowed due to the spacing of the cement 25 from the extension member 22 of the inner housing 21. The sleeve 57 by preventing shear bonding of the cement 25, will accommodate the flexing movement.

If the well is later abandoned, it will be desirable to recover the outer housing 13 and inner housing 21. An explosive charge will be used to cut off casing 23 from housing 21. A diver or remote operated vehicle will loosen bolt 55 and remove clamp ring 49. This releases the latch ring 43 from the latch ring 41. The inner housing 21 can then be pulled to the surface. The outer housing 13 will be removed conventionally.

Figure 3:
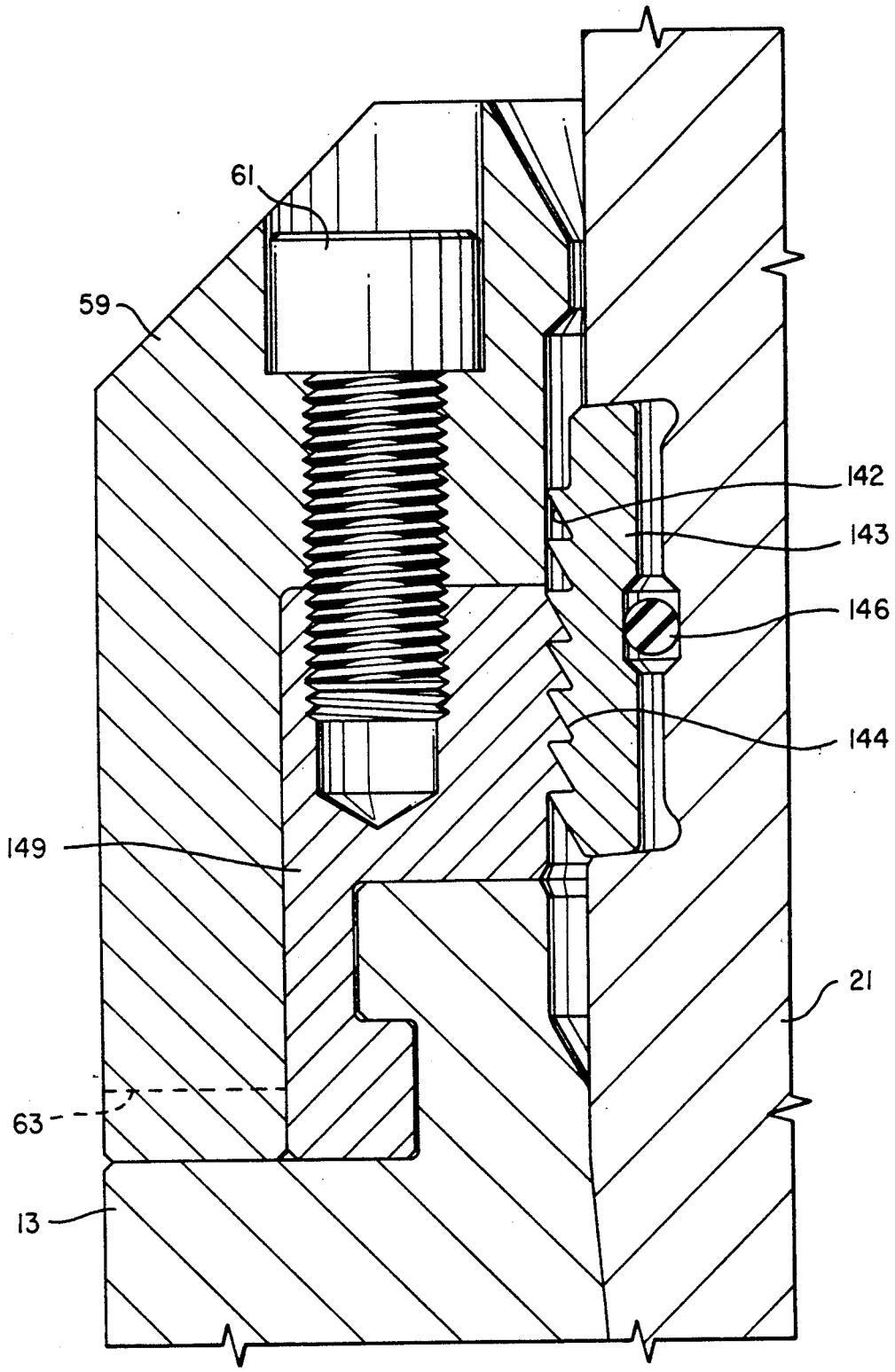
FIG. 3 is an enlarged view of an alternate embodiment of an upper portion of the inner and outer housings constructed in accordance with this invention.
Figure 4:
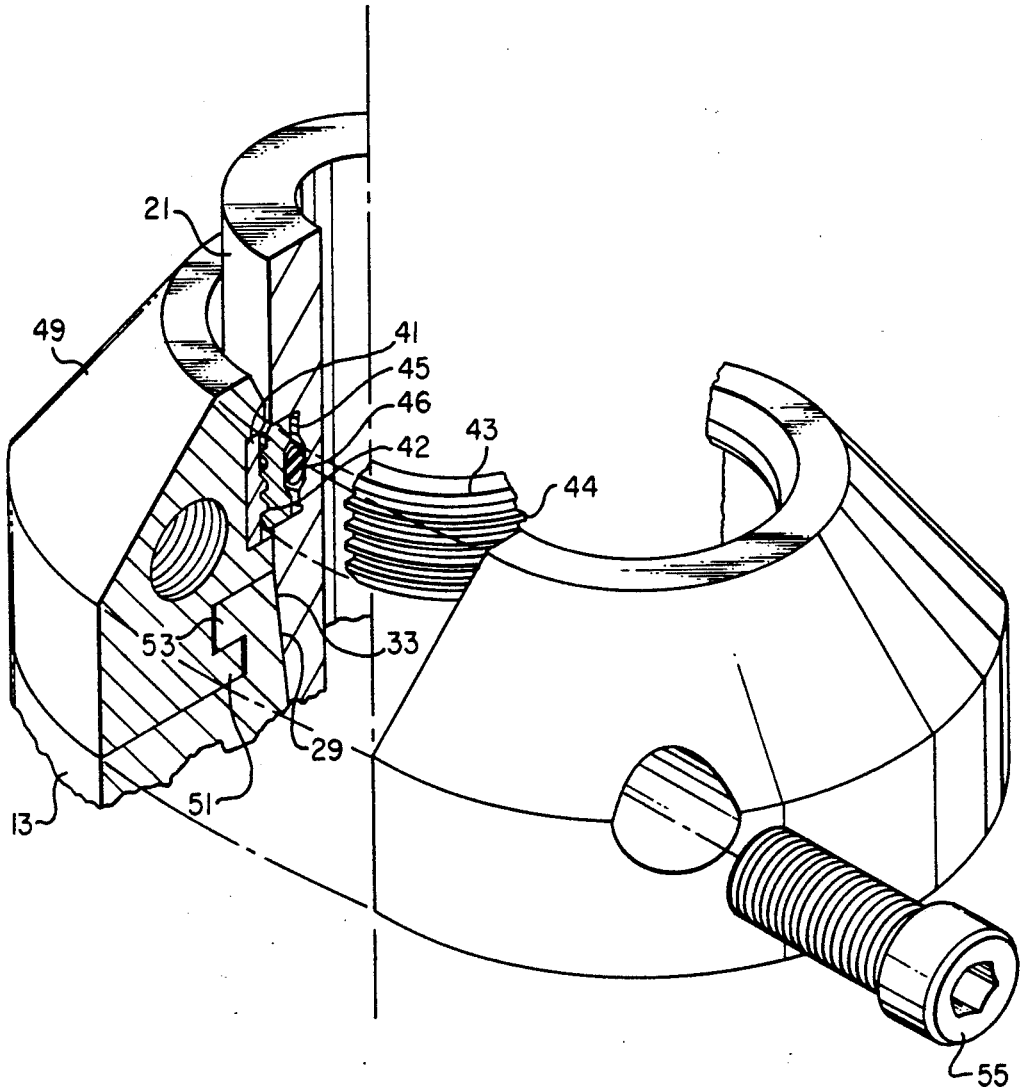
FIG. 4 is a partial exploded perspective view of the upper portion of the inner and outer housings, as shown in FIG. 2.
Figure 5:
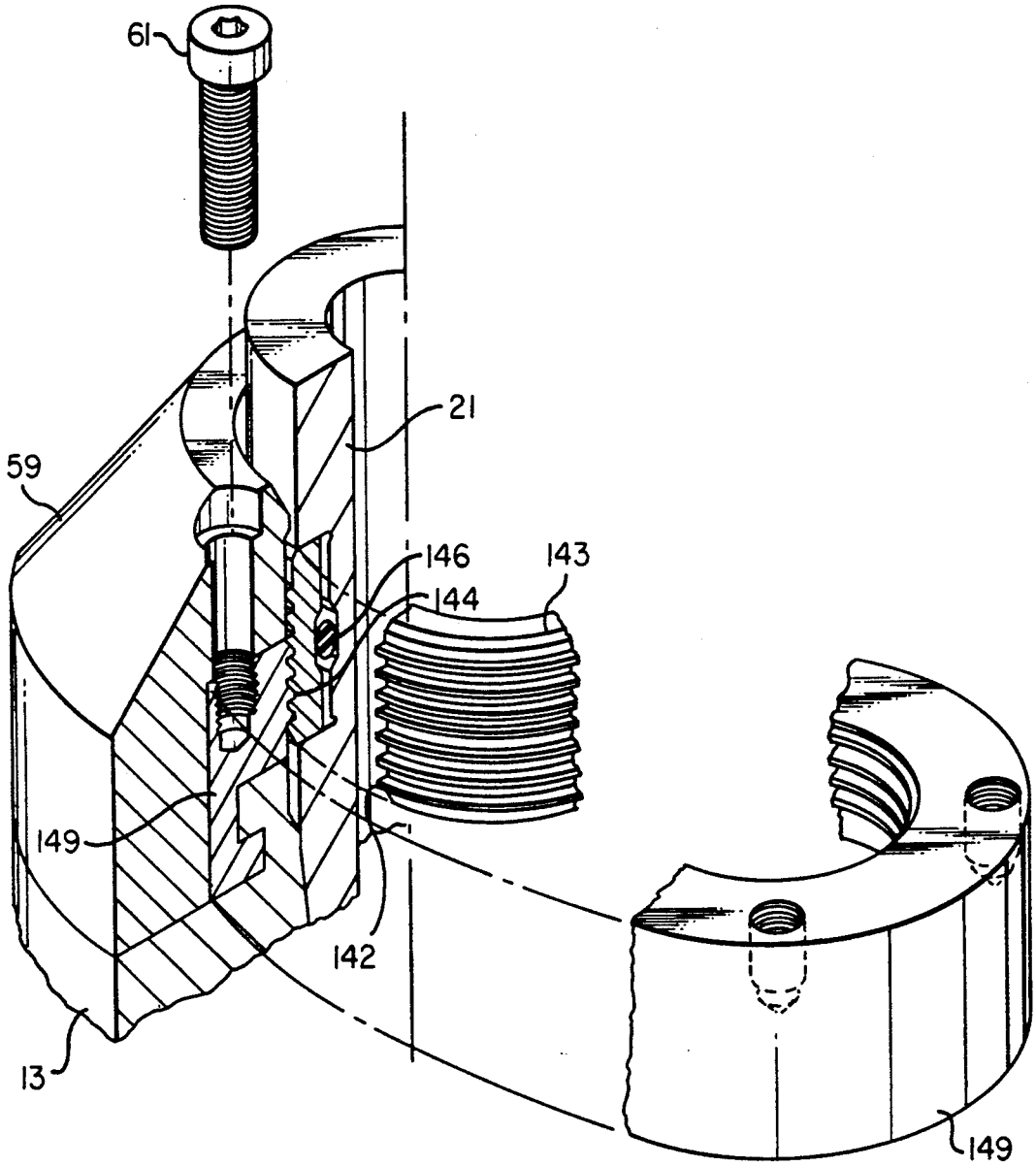
FIG. 5 is an enlarged partial exploded view of the alternative embodiment of the upper portion of the inner and outer housings, as shown in FIG. 3.

In the embodiment of FIG. 3, the two halves of clamp ring 149 are retained by a solid retaining ring 59. Retaining ring 59 has a bore which fits tightly around the exterior of the clamp ring 149. Vertical bolts 61 bolt the retaining ring 59 to the two halves of the clamp ring 149. Latch ring 143 has teeth or grooves 142 which ratchet into grooves 144 formed in the bore of the clamp ring 149. O-ring 146 biases the latch ring 143 outward.

For removal, pry apart slots 63 locate on the lower end of the retaining ring 59. This allows a pry bar to be placed between the upper end of the outer housing 13 and the retaining ring 59 to push it upward after bolts 61 have been removed. Once retaining ring 59 is above the clamp ring 149, the two halves of the clamp ring 149 can be removed from the outer housing 13.

The invention has significant advantages. It stabilizes the inner housing within the outer housing, reducing movement between the two housings. Flexing movement is allowed to occur below the inner housing and outer housing due to the sleeve which separates the cement from the lower portion of the inner housing. The extension member of the inner housing may be much lighter than the prior art extension member. The clamp ring enables the inner housing to be easily removed from the outer housing if the well is abandoned.

While the invention has been shown in only two of its forms, it should be apparent to those skilled in the art that it is not so limited, but is susceptible to various changes without departing from the scope of the invention.

We claim:

1. In a subsea well having a tubular outer housing protruding upward from the sea floor, the outer housing having a bore with a longitudinal axis, a tubular inner housing adapted to be lowered into the outer housing and having a lower end secured to a string of casing extending into the well, the inner housing having an upper end adapted to be secured to a string of conduit extending to a drilling rig, the improvement comprising in combination:

an upper tapered section in the bore of the outer housing;

a lower tapered section in the bore of the outer housing at a selected axial distance below the upper tapered section;

upper and lower tapered sections integrally formed on the exterior of the inner housing at substantially the same axial distance apart as the upper and lower tapered sections in the outer housings, the upper and lower tapered sections on the inner housing mating in metal-to-metal frictional contact with the upper and lower tapered sections of the outer housing, respectively as the inner housing is lowered into the outer housing, to transmit bending forces on the inner housing from lateral movement of the string of conduit through the inner housing to the outer housing; and locking means having a portion located on the outer housing above the upper tapered section of the outer housing and a portion on the inner housing above the upper tapered section of the inner housing for slidingly engaging each other as the inner housing is lowered into the outer housing and for preventing upward movement of the inner housing relative to the outer housing once the upper tapered sections have fully engaged each other and once the lower tapered sections have fully engaged each other; and the locking means having release means operable prior to disengaging the upper tapered sections from each other and prior to disengaging the lower sections from each other for releasing the inner housing to be pulled from the outer housing if the well is to be abandoned.

2. In a subsea well having a tubular outer housing protruding upward from the sea floor, the outer housing having a bore, a tubular inner housing having a lower end secured to a string of casing extending into the well, the inner housing having an upper end adapted to be secured to a string of conduit extending to a drilling rig, the improvement comprising in combination:

an upper tapered section formed in the bore of the outer housing;

a lower tapered section formed in the bore of the outer housing at a selected axial distance below the upper tapered section;

upper and lower tapered sections formed on the exterior of the inner housing at substantially the same axial distance apart as the upper and lower tapered sections in the outer housings, the upper and lower tapered sections on the inner housing mating in metal-to-metal frictional contact with the upper and lower tapered sections of the outer housing, respectively; and protective means on the lower end of the inner housing and extending downward a selected distance, the protective means surrounding the lower end of the inner housing and having an exterior exposed to cement return flow for preventing cement from contacting the exterior of the lower end of the inner housing to allow slight lateral flexing of the inner housing due to bending of the riser.

3. In a subsea well having a tubular outer housing protruding upward from the sea floor, the outer housing having a bore, a tubular inner housing having a lower end secured to a string of casing extending into the well, and upper end adapted to be secured to a string of conduit extending to a drilling rig, the improvement comprising in combination:

an upper tapered section formed in the bore of the outer housing;

a lower tapered section formed in the bore of the outer housing at a selected axial distance below the upper tapered section;

upper and lower tapered sections formed on the exterior of the inner housing at substantially the same axial distance apart as the upper and lower tapered sections in the outer housings, the upper and lower tapered sections on the inner housing mating in metal-to-metal frictional contact with the upper and lower tapered sections of the outer housing, respectively;

a clamp ring having a bore;

mounting means for releasably mounting the clamp ring to the upper end of the outer housing above the upper tapered section of the outer housing;

a latching member located in the bore of the clamp ring;

a latching member located on the exterior of the inner housing above the upper tapered section of the inner housing for mating with the latching member in the clamp ring; and means for allowing one of the latching members to deflect radially to allow the latching member on the inner housing to ratchet into the latching member in the clamp ring as the inner housing moves downward into the outer housing, the mounting means allowing the clamp ring to be removed from the outer housing to disengage the latching members from each other for subsequent removal of the inner housing.

4. In a subsea well having a tubular outer housing protruding upward from the sea floor, the outer housing having a bore, a tubular inner housing adapted to be lowered into the outer housing and having a lower end secured to a string of casing extending into the well, and an upper end adapted to be secured to a string of conduit extending to a drilling rig, the improvement comprising in combination:

an upper tapered section formed in the bore of the outer housing;

a lower tapered section formed in the bore of the outer housing at selected axial distance below the upper tapered section;

upper and lower tapered sections formed on the exterior of the inner housing at substantially the same axial distance apart as the upper and lower tapered sections in the outer housings, the upper and lower tapered sections on the inner housing mating in metal-to-metal frictional contact with the upper and lower tapered sections of the outer housing, respectively when the inner housing is lowered into the outer housing;

a clamp ring having a bore;

mounting means for releasably mounting the clamp ring to the upper end o the outer housing above the upper tapered section of the outer housing;

a latching member located in the bore of the clamp ring;

a latching member located on the exterior of the inner housing above the upper tapered section of the inner housing for mating with the latching member in the clamp ring;

protective means on the lower end of the inner housing and extending downward a selected distance, the protective means surrounding the lower end of the inner housing and having an exterior exposed to cement return flow for preventing cement from contacting the exterior of the lower end of the inner housing to allow slight lateral flexing of the inner housing due to bending of the riser; and means for allowing one of the latching members to deflect radially to allow the latching member on the inner housing to ratchet into the latching member in the clamp ring as the inner housing moves downward into the outer housing, the mounting means allowing the clamp ring to be removed from the outer housing to disengage the latching members from each other for subsequent removal of the inner housing.

5. In a subsea well having a tubular outer housing protruding upward from the sea floor and having a bore, the improvement comprising in combination:

a tubular inner housing having a lower extension member secured to a string of casing extending into the well, and an upper end adapted to be secured to a string of conduit extending to a drilling rig; and an elastomeric sleeve located on the lower extension member of the inner housing and extending downward a selected distance, the elastomeric sleeve having an exterior that is exposed to cement return flow during cementing of the string of casing for preventing cement from contacting a portion of the exterior of the lower extension member to allow slight lateral flexing of the inner housing due to bending of the riser.

6. In a subsea well having a tubular outer housing protruding upward from the sea floor and having a bore, a tubular inner housing connected on its lower end to a string of casing and on its upper end to a string of conduit extending upward to a drilling rig, the inner housing adapted to be lowered into the outer housing, the improvement comprising in combination:

a clamp ring having a bore;

mounting means for releasably mounting the clamp ring to the upper end of the outer housing;

a latching member located in the bore of the clamp ring;

a latching member located on the exterior of the inner housing for mating with the latching member in the clamp ring; and means for allowing one of the latching members to deflect radially to allow the latching member on the inner housing to ratchet into the latching member in the clamp ring as the inner housing moves downward into the outer housing, the mounting means allowing the clamp ring to be removed from the outer housing to disengage the latching members from each other for subsequent removal of the inner housing.

7. In a subsea well having a tubular outer housing protruding upward from the sea floor and having a bore, a tubular inner housing connected on its lower end to a string of casing and on its upper end to a string of conduit extending upward to a drilling rig, the improvement comprising in combination:

a clamp ring having a bore and split into two halves;

mounting means for releasably mounting the two halves of the clamp ring to the upper end of the outer housing;

a set of teeth located in the bore of the clamp ring;

a set of teeth located on the exterior of the inner housing for mating with the teeth in the clamp ring; and means for allowing one of the sets of teeth to deflect radially to allow the set of teeth on the inner housing to ratchet into the set of teeth in the clamp ring as the inner housing moves downward into the outer housing, the mounting means allowing the clamp ring to be removed from the outer housing to disengage the sets of teeth from each other for subsequent removal of the inner housing.

8. In a subsea well having a tubular outer housing protruding upward from the sea floor and having a bore, a tubular inner housing connected on its lower end to a string of casing and on its upper end to a string of conduit extending upward to a drilling rig, the improvement comprising in combination:

a clamp ring having a bore and split into two halves, each of the halves having a radially inward extending flange;

a circumferentially extending recess on the upper end of the outer housing;

bolt means for bolting the two halves of the clamp ring to each other on the upper end of the outer housing, with the flanges extending into the recess;

a set of teeth located in the bore of the clamp ring;

a set of teeth located on the exterior of the inner housing for mating with the set of teeth in the clamp ring; and means for allowing one of the sets of teeth to deflect radially to allow the set of teeth on the inner housing to ratchet into the set of teeth in the clamp ring as the inner housing moves downward into the outer housing, the bolt means allowing the clamp ring to be removed rom the outer housing to disengage the sets of teeth from each other for subsequent removal of the inner housing.

9. In a subsea well having a tubular outer housing protruding upward from the sea floor and having a bore, a tubular inner housing connected on its lower end to a string of casing and on its upper end to a string of conduit extending upward to a drilling rig, the improvement comprising in combination:

a clamp ring having a bore and split into two halves, each of the halves having a radially inward extending flange;

a circumferentially extending recess on the upper end of the outer housing;

a solid continuous retaining ring mounted around the exterior of the clamp ring to retain the halves together with the flanges extending into the recess;

bolt means for bolting the retaining ring to the two halves of the clamp ring;

a latching member located in the bore of the clamp ring;

a latching member located on the exterior of the inner housing for mating with the latching member in the clamp ring; and means for allowing one of the latching members to deflect radially to allow the latching member on the inner housing to ratchet into the latching member in the clamp ring as the inner housing moves downward into the outer housing, the bolt means allowing the retaining ring to be pulled upward rom the clamp ring, allowing the two halves to be removed from the outer housing to disengage the latching members from each other for subsequent removal of the inner housing.

* * * * *